US010219087B2

(12) United States Patent
Dalhoff et al.

(10) Patent No.: US 10,219,087 B2
(45) Date of Patent: Feb. 26, 2019

(54) HEARING AID THAT CAN BE INTRODUCED INTO THE AUDITORY CANAL AND HEARING AID SYSTEM

(71) Applicant: EBERHARD KARLS UNIVERSITAT TUBINGEN MEDIZINISCHE FAKULTAT, Tubingen (DE)

(72) Inventors: Ernst Dalhoff, Rottenburg (DE); Hans-Peter Zenner, Tubingen (DE)

(73) Assignee: Eberhard Karls Universitat Tubingen Medizinische Fakultat, Tubingen (DE)

( * ) Notice: Subject to any disclaimer, the term of this patent is extended or adjusted under 35 U.S.C. 154(b) by 207 days.

(21) Appl. No.: 15/107,888

(22) PCT Filed: Dec. 18, 2014

(86) PCT No.: PCT/EP2014/078440
§ 371 (c)(1),
(2) Date: Jun. 23, 2016

(87) PCT Pub. No.: WO2015/097056
PCT Pub. Date: Jul. 2, 2015

(65) Prior Publication Data

US 2016/0323680 A1 Nov. 3, 2016

(30) Foreign Application Priority Data

Dec. 23, 2013 (DE) ..... 10 2013 114 771

(51) Int. Cl.
*H04R 25/00* (2006.01)
*H04R 17/00* (2006.01)

(52) U.S. Cl.
CPC ..... *H04R 25/606* (2013.01); *H04R 17/00* (2013.01); *H04R 25/554* (2013.01); *H04R 2225/025* (2013.01); *H04R 2460/09* (2013.01)

(58) Field of Classification Search
None
See application file for complete search history.

(56) References Cited

U.S. PATENT DOCUMENTS 4,800,884 A 1/1989 Heide et al.
5,259,032 A * 11/1993 Perkins ..... H04R 25/606 381/312

(Continued)

FOREIGN PATENT DOCUMENTS

DE 2044870 3/1972
DE 3788529 6/1994

(Continued)

OTHER PUBLICATIONS

Examination Report for DE 102013114771.2, dated Oct. 14, 2014, 1 page (English translation).

(Continued)

*Primary Examiner* — Matthew A Eason
(74) *Attorney, Agent, or Firm* — Rimon, P.C.

(57) ABSTRACT

In a hearing aid (26) that can be inserted into the ear canal (12) of a patient, comprising an actuator (31) effecting a mechanical stimulation of the tympanic membrane (14), the actuator (31) comprises an inner surface (32) associated with the tympanic membrane (14) and an outer surface (42) associated with the ear canal (12) and is configured as an areal disk actuator, whose deformation stimulates the tympanic membrane (14) by areal deformation. On the actuator (31) at a distance from the outer surface (42) a cover plate (43) is arranged which together with the outer surface (42) delimits a preferably lenticular cavity (48).

29 Claims, 5 Drawing Sheets

(56) References Cited

U.S. PATENT DOCUMENTS

| | | | | |
|---|---|---|---|---|
| 5,295,191 | A | 3/1994 | Vroenhoven et al. | |
| 5,556,423 | A | 9/1996 | Chow et al. | |
| 6,298,270 | B1 | 10/2001 | Nisch et al. | |
| 7,289,639 | B2 | 10/2007 | Abel et al. | |
| 7,867,160 | B2 | 1/2011 | Pluvinage et al. | |
| 2010/0152527 | A1 | 6/2010 | Puria et al. | |
| 2012/0014546 | A1* | 1/2012 | Puria | H04R 11/02 381/320 |
| 2012/0053393 | A1* | 3/2012 | Kaltenbacher | H04R 17/00 600/25 |

FOREIGN PATENT DOCUMENTS

| | | |
|---|---|---|
| DE | 69204555 | 5/1996 |
| DE | 19705988 | 4/1998 |
| DE | 10154390 | 12/2002 |
| EP | 0696907 | 2/1996 |
| EP | 1470737 | 10/2004 |
| EP | 2362686 | 8/2011 |
| EP | 2538697 | 12/2012 |

OTHER PUBLICATIONS

Fay et al., "Preliminary evaluation of a light-based contact hearing device for the hearing impaired," Otology and Neurotology (2013) 34(5):912-921.

Goll et al., "Concept and evaluation of an endaurally insertable middle-ear implant," Medical Engineering and Physics (2013) 35:532-536.

Haynes et al., "Middle ear implantable hearing devices: an overview," Trends in Amplification (2009) 13:206-214.

International Preliminary Report on Patentability for PCT/EP2014/078440, dated Jun. 28, 2016, 19 pages.

Perkins et al., "The EarLens system: New sound transduction methods," Hearing Research (2010) 263:104-113.

Rutschmann, "Magnetic audition—auditory stimulation by means of alternating magnetic fields acting on a permanent magnet fixed to the eardrum," IRE transactions on medical electronics (1959) 6:22-23.

Zenner et al., "Aktive elektronische Horimplantate fur Mittel- und Innenohrschwerhorige-eine neue Ara der Ohrchirurgie," HNO (Edition Oct. 1997), pp. 749-774, Springer Verlag (English summary).

* cited by examiner

HEARING AID THAT CAN BE INTRODUCED INTO THE AUDITORY CANAL AND HEARING AID SYSTEM

This application is the national phase of PCT/EP2014/078440 having an international filing date of Dec. 18, 2014, which claims priority to German Patent Application No. 10 2013 114 771.2, filed on Dec. 23, 2013. The entire contents of the above-listed applications are incorporated herein by this reference in their entireties. The present invention relates to a hearing aid that can be inserted into the ear canal of a patient, comprising an actuator effecting a mechanical stimulation of the tympanic membrane.

Such hearing aids are known in the prior art.

Hearing loss is a serious social problem, since on average about 10 to 20% of the population in developed countries are affected. Hearing loss is often not curable today and thereby causes a reduction in the quality of life. Hearing systems that can be implanted and/or inserted offer a solution in this situation.

In the article "Aktive elektronische Hörimplantate für Mittel- und In-nenohrschwerhörige—eine neue Ära der Ohrchirurgie" by H. P. Zenner and H. Leysieffer (published in HNO, Edition 10/97, pages 749-774, Springer Verlag) terms in the context of hearing implants are defined, which are also used below. In accordance with the article it is essentially distinguished between acoustic and electro-mechanical transducers, which form part of hearing implants. Further, vibratory transducers are known, including electromagnetic and piezoelectric transducers.

An acoustic transducer generates (amplified) sound waves which in turn cause vibrations of the tympanic membrane (ear drum). A telephone handset is a very simple example of an acoustic transducer. The ear piece of the telephone handset converts, for example, voice signals into vibrations of a speaker membrane, which it has previously received via wired transmission. The speaker in turn causes a vibration of the tympanic membrane. These vibrations at varying frequencies and amplitudes result in sound perception in individuals with normally functioning hearing.

DE 692 04 555 T2 describes an acoustic transducer. The acoustic transducer receives its input signal from an infrared receiver. Therein, the modulated signals for sound reproduction are provided via IR radiation from outside the ear into the outer ear, where the IR-receiver with the speaker for acoustic coupling to the tympanic membrane is arranged.

DE 37 88 529 T2 discloses an electromagnetic transducer. Such electromagnetic transducers are used in most conventional hearing implants. They convert (electro)magnetic fields comprising audio information into vibrations which are in turn applied to the tympanic membrane or parts of the middle ear. The transducer, typically a magnet, is displaced or moved by the electromagnetic field to apply a vibrating motion for example on the tympanic membrane or the ossicles, whereby the user of such an electromagnetically-driven system perceives sound. This way of sound perception has some advantages over an acoustic-driven system, in particular in terms of quality, efficiency and in particular with respect to an acoustic feedback which is common to all hearing systems.

For more than 40 years, the mechanical stimulation of the ossicles is being studied in hearing research as an alternative to a conventional hearing aid which amplifies the sound pressure in the ear canal, where both an excitation in the middle ear and on the tympanic membrane can be considered. The mechanical stimulation has advantages over the conventional acoustic simulation at high required gain in terms of fidelity (distortions).

The mechanical stimulation at the ossicles is now clinical practice in the form of so-called active middle ear implants; see Haynes et al., "Middle ear implantable hearing devices: an overview" in Trends Amplif. 13 (2009). 206-214.

For the stimulation at the tympanic membrane, the application of a miniature magnet on the tympanic membrane has been proposed which is designed as a punctually stimulating actuator that engages at the umbo or the central region of the tympanic membrane. The stimulation of the magnet can be effected with a coil outside or inside of the ear canal; see DE 20 44 870 A1.

In U.S. Pat. No. 5,259,032 A and US 2010/0152527 A1 based thereon, it was proposed to use a so-called ear lens for the punctual stimulation at the umbo which comprises an actuator on a support membrane having a form corresponding to that of the individual tympanic membrane such that it adheres to the tympanic membrane by molecular forces at the hydro-mechanical boundary layer. The actuator comprises a permanent magnet, which is supplied in wireless form electromagnetically with signals and energy via a signal generator module that has been inserted into the ear canal.

This system has meanwhile been tested on 16 subjects, wherein an individual casting of each of the tympanic membrane was made; see Perkins et al., "The EarLens system: new sound transduction methods", Hear. Res., 263 (2010), 104-113. Therein, the permanent magnet is encapsulated in a customized silicone form. The signal and energy transmission has, as an alternative, also been provided in wireless form electromagnetically via a coil at a distal end of a conventional behind-the-ear-(BTE)-hearing aid.

These approaches require a mechanical fixation of the coil driving the magnet relative to the tympanic membrane, i.e., either in the ear canal or the transition between the ear canal and the tympanic membrane.

U.S. Pat. No. 7,867,160 B2 describes a variant of this hearing aid in which a supply module, which is adapted to the form of the outer ear, transmits signals via light to the hearing aid that sits on the outside of the tympanic membrane. The hearing aid comprises a support structure applied to the umbo as well as a bimorph structure for punctual stimulation of the tympanic membrane.

Fay et al., "Preliminary Evaluation of a Light-Based Contact Hearing Device for the Hearing Impaired", (2013) Otol. Neurotol, propose a system which is fundamentally different from the previously predominant permanent magnets. Therein, a peritympanal impression of the tympanic membrane is taken and a corresponding annular silicone structure is fabricated, which sits in the annular recess between ear canal wall and the tympanic membrane. At this structure an actuator structure is mounted that effectively builds a bridge over the tympanic membrane and therefrom directly stimulates the umbo, i.e., the central region, with a micro-actuator by transferring the membrane forces onto the ossicles.

Besides the electromagnetic signal and energy transmission, an optical transmission path has been proposed for eye implants (DE 197 05 988 C2) and later also for middle ear implants; see EP 1 470 737 B1 und Goll et al., "Concept and evaluation of an endaurally insertable middle-ear implant" in Med Eng Phys 35 (103), 532-536 35.

The optical transmission has an advantage over the electro-mechanical transmission in that the energy loss is generally not substantially dependent on the distance and orientation between sender and receiver and furthermore can be built much smaller under comparable transmission circumstances. This plays an important role in hearing implants which are to be completely (also including receiver) inserted into the relatively small middle ear. Furthermore, the substantial distance dependency leads to undesired signal modulation if the transmission path is geometrically not highly stable.

A problem of all hearing aids that do not block the ear canal is acoustic feedback of the amplified sound to the receiver microphone, which is usually arranged behind the ear in BTE devices. This problem can be mitigated with implants or also with ear lenses; in Perkins et al., l.c., a feedback gain margin in the region of 3 kHz of 12±8 dB is described with respect to a microphone inside the ear canal.

Fay et al., l.c., report an average value of about 40 dB with respect to a microphone at the conventional position behind the ear cup. A microphone within the ear canal in the so-called open supply has the eminently important advantage that the directional information, which in part results from the individual head-related amplitude transmission function of the sound, is maintained unaltered.

DE 101 54 390 A1 discloses a hearing aid for insertion into the ear canal that functions according to the principle of an acoustic transducer, in which a frequency-dependent acoustic attenuation element is provided which is intended to prevent disruptive feedback noise at higher frequencies. This measure shall provide the same hearing impression as an open ear canal even though the ear canal is closed by the hearing aid. The acoustic attenuation element can be implemented as an acoustic shield comprising cascaded lamellas that are arranged in several layers in succession twisted with respect to one another in a circumferential direction.

EP 2 362 686 A2 describes an acoustic transducer for generation of acoustic vibrations which can be inserted into the ear and is implanted in particular into the middle ear. The acoustic transducer comprises a carrier structure and a piezoelectric layer, whereby a displacement of the membrane structure is achieved according to the bimorph principle, so that the membrane structure can be put into in vibration by applied electrical control signals and thereby generates acoustic vibrations in the range between 2 Hz and 20.000 to 30.000 Hz. The acoustic transducer shall be implemented in or in front of the round or oval window in the middle ear and emit corresponding sound waves there. Alternatively, it is proposed to use the acoustic transducer in conventional hearing aids that can sit directly on the tympanic membrane, whereby the edge of the acoustic transducer would have to be fixed at the transition between tympanic membrane and ear canal. The supply of the acoustic transducer with control signals and energy is effected via cables guided into the ear.

Against this background it is an object of the present invention to improve the afore-mentioned hearing aid such that it allows for a better stimulation of the tympanic membrane, preferably having low acoustic feedback.

According to the invention this object s achieved in the hearing aid mentioned at the outset in that the actuator comprises an inner surface associated with the tympanic membrane and an outer surface associated with the ear canal and which, on the one hand, is configured as an areal disk actuator whose deformation stimulates the tympanic membrane by areal deformation, or on the other hand in that a cover plate, which is preferably convex towards the ear canal, is arranged on the actuator at distance from the outer surface which together with the outer surface delimits a preferably lenticular cavity.

By these two measures, which may be used alternatively or cumulatively, the invention provides an improved hearing aid in a simple manner.

According to one aspect, the stimulation of the tympanic membrane is now provided over an area and no longer via an element as known in the prior art that can be seen as an approximately punctually stimulating actuator that engages at the umbo or central region of the tympanic membrane. According to the invention, the stimulation is effected by deformation of an element contacting the greater part of the tympanic membrane and transmitting the deformation to the tympanic membrane based on the surface tension in the boundary layer between the inner surface of the actuator and the tympanic membrane.

The stimulation of the tympanic membrane is hereby effected according to the invention not by vibration of an actuator which itself is non-deformable but by deformation of the tympanic membrane in itself over an area via the areal deformable actuator.

For this, for example, a version of the piezo actuator described in EP 2 362 686 A2 which has been adapted in its dimensions can be suitable which is further formed very thin (2-20 μm) and adapted with respect to its impedance to that of the tympanic membrane. This actuator thereby has the advantage of operating up to high frequencies (f>10 kHz) with an inconsiderable increase of the actual effective inertial mass.

Further, it is advantageous that the actuator is adapted to be applied over an area at the surface of the tympanic membrane facing the ear canal, preferably by means of adhesive forces.

In this way, the actuator is held at the tympanic membrane itself, a fixation of its edge at a wall of the ear canal or other mechanical counter bearing is not needed. Nonetheless it is possible, according to the findings of the inventors, to achieve an areal deformation of the tympanic membrane, wherein the forces between the actuator and the tympanic membrane are purely transmitted via adhesion. This was not to be expected based on the known hearing aids.

This feature provides for easy and quick insertion of the hearing aid. For inserting the hearing aid no invasive surgery is required. Either the treating physician or a technician can place the hearing aid on the tympanic membrane whereto preferably neither an adhesive nor similar fixing means have to be used.

The proximal end of the outer ear in the immediate vicinity of the tympanic membrane in particular does not have the body's own mechanism to transport particles from the inner part of the outer ear in direction of the outer part of the outer ear. If the hearing aid is correctly placed on the tympanic membrane it will remain fixed at the desired location by the prevalent adhesive forces between the tympanic membrane and the actuator. Should it be necessary to change the hearing aid, this can easily be done by pulling it off the tympanic membrane. Usually the tympanic membrane will not be hurt thereby. This replacement can be made relatively quick and in an outpatient setting.

It goes without saying that all materials used are biocompatible.

According to another aspect of the present invention a hearing aid with a preferably lenticular, hollow structure is formed by attachment of a rigid, preferably arched cover plate on the outer surface of the actuator facing away from the tympanic membrane. The cover plate assumes the function of an acoustic shield however does not require cascaded elements as known from the above-mentioned DE 101 54 390 A1. Because the cover plate only oscillates with a, depending on the diameter negligible, amplitude of the outer periphery of the tympanic membrane, the acoustic feedback of the vibration of the tympanic membrane, which is typically amplified by 30-40 dB amplified in the hearing aid application, into the microphone of the hearing aid is substantially reduced. This microphone can be arranged inside the ear canal or behind the ear.

Mathematical simulations show that the rigidity of the air volume within the actuator, which in this concept represents an acoustic load impedance for the actuator, in an approximately 1 mm high interior corresponds to a mechanical load impedance of 190 N/m. It thus corresponds to about 1/10 of the mechanical input rigidity at the umbo which is about 1.9 kN/m.

The cover plate can be made of a rigid material and can be designed flat or arched. Besides the function as an acoustic shield the cover plate can further act as a support for microelectronic elements and circuitry and preferably carry a chip battery that serves as the electric supply of the circuitry.

The object underlying the invention is completely achieved by these two alternative ways, respectively.

However, it is particularly preferred if both measures are implemented such that the effective coupling is accompanied by an effective reduction in acoustic feedback.

Further it is preferred if the hearing aid comprises at least a first receiver for energy signals, preferably comprising at least one optoelectronic sensor that converts light energy to electrical energy, wherein further preferably the at least one first receiver comprises an areal array of optoelectronic sensors.

Hereby it is advantageous that the energy supply of the hearing aid is provided wirelessly, wherein the optical transmission of the energy provides the additional advantage that the energy loss is low, because light rays can also be guided in a directed manner in the ear canal to the receiver. The light rays can be brought into the ear canal via light guides or can be generated by a supply module arranged in the ear canal which under certain circumstances can also be removed and inserted by the patient himself.

The supply module can, for example, be charged extracorporally with electrical energy which is then converted to optical energy during use and is guided from the supply module positioned further out in the ear canal to the hearing aid located at the inside of the ear canal at the tympanic membrane and is there again transformed into electrical energy.

If the first receiver comprises an areal array of optoelectronic sensors, the optical energy transmission is also substantially insensitive to misalignment between the transmitter and the receiver.

Further it is preferred if the hearing aid comprises at least a second receiver for hearing signals, which preferably comprises a microphone unit, which receives acoustic signals as hearing signals and converts them into electrical control signals for the actuator.

Hereby it is advantageous that also the transmission of the hearing signals is provided wirelessly. If the hearing signals are thereby transmitted as acoustic signals to the microphone unit, only the energy has to be transmitted wirelessly to the hearing aid. The supply unit then essentially only has to provide the required electrical energy, for example by a rechargeable energy storage device. and a light emitter for the optical energy transmission. The light signals can be emitted for example in the near infrared region, for example at approximately 800 nm.

The microphone unit can comprise one or more electret microphones, which can be manufactured in the required small dimensions with sufficient audio quality.

If at least the membrane of the microphone unit is arranged on the side facing the ear canal besides or on the cover plate, i.e., arranged above the acoustic shield formed by the cover plate, the inventors have found that despite the spatial proximity of microphone and actuator a good shielding of the microphone from acoustic feedback signals is provided.

It is further advantageous that the microphone is arranged close to the tympanic membrane such that the reception of the acoustic signals by the hearing aid is carried out where also the healthy ear acquires the acoustic signals with the tympanic membrane. The natural directivity of the ear canal can thus be continuously used in spite of the hearing aid, so that orientation by listening is further possible almost unaffectedly.

The cover plate and the areal coupling of the disk actuator to the tympanic membrane each on its own respectively, however in particular in combination, enable that the microphone unit can be directly arranged at the hearing aid inserted into the ear canal at the tympanic membrane, without leading to a disturbing feedback of the vibrations transmitted to the tympanic membrane onto the microphone.

In this case it is then preferred that the microphone unit comprises a membrane on which the at least one first receiver is arranged at least in part.

Hereby it is advantageous that the entire area of the membrane is available for both functions which not only has positive impact on the sensitivity of the microphone but also on the position insensitivity of the optical energy transmissions link. For this purpose thin-film photo diodes can be used as the first receiver which is are arranged on the membrane of the microphone or are implemented as part of the membrane.

An example for photo diodes which are formed in a flexible, grid-like substrate can be found in EP 0 696 907 B1.

Further it is preferred that a spacer ring is arranged between the areal actor and the cover plate, in particular that the cover plate is rigid compared to the actuator, further preferably at least one vent opening leading into the cavity is provided in the cover plate, which preferably has a diameter allowing an exchange of air between the ear canal and the cavity only for low frequencies of preferably below 20 Hz, wherein the diameter of the vent opening is further preferably between 0.01 and 0.1 mm.

Hereby it is advantageous that the disk actuator, cover plate and spacer ring provide a closed air volume for acoustic frequencies.

Further it is advantageous that the tiny vent opening enables a low-frequency exchange of air between the inner of the cavity and the air in the ear canal to avoid static pressure differences.

The hearing aid thereby has a diameter between 4 and 10 mm, such that a greater part of the area of the tympanic membrane of a patient is available for the stimulation as well as for receiving the energy signals and the membrane of the microphone unit.

The total thickness of the hearing aid, measured transversely to its diameter, in an embodiment is approximately 2 mm, wherein the portion of the cover plate of this thickness is no more than approximately 0.2 mm.

The inner surface of the actuator is preferably adapted to the form of the tympanic membrane such that the inner surface is attachable to the tympanic membrane centrically to the umbo.

This enables easy positioning of the hearing aid at the tympanic membrane and provides for efficient coupling of the actuator to the tympanic membrane.

In general it is preferred that the hearing aid comprises a control unit which converts energy signals of at least one first receiver and hearing signals of at least one second receiver into control signals for the actuator. The control unit can be arranged on the rigid cover plate.

This control unit in an embodiment serves for converting the electrical output signals of the microphone unit into control signals for the disk actuator and for providing the required electrical energy. Further, in the control unit signal processing can be carried out in which for example the pitch of the received acoustic signals can be changed and/or certain frequency ranges can be amplified differently to meet the individual needs of the patient.

Against this background the present invention also relates to a hearing aid system comprising a supply module and the hearing aid that can be inserted into the ear canal of the patient, wherein on the hearing aid a first receiver for energy signals and at least one second receiver for hearing signals is provided and wherein the supply module comprises at least one sender for energy signals which preferably comprises a light emitter which is preferably selected from a group comprising light guides, lasers, LEDs and OLEDs.

The supply module hereby serves for providing the hearing aid with electrical energy and is preferably itself also inserted into the ear canal to the inner form of which it is adapted. However, it can also be arranged behind the ear, whereby the light radiation can then be guided into the ear canal via light guides.

The supply module can also comprise a light emitter, preferably an LED or a laser, for hearing signals, whereby in this case no microphone unit is arranged on the hearing aid but further light receivers, which convert the optically received hearing signals into electrical signals which are then used for excitation of the actuator.

Further advantages will be apparent from the description and the attached drawings.

It is to be understood that the above-mentioned features and the features to be explained below cannot only be used in the respective shown combination but also in other combinations or on its own without departing from the scope of the present invention.

An embodiment of the invention is illustrated in the attached drawings and will be explained in more detail in the following description.

Figure 1:
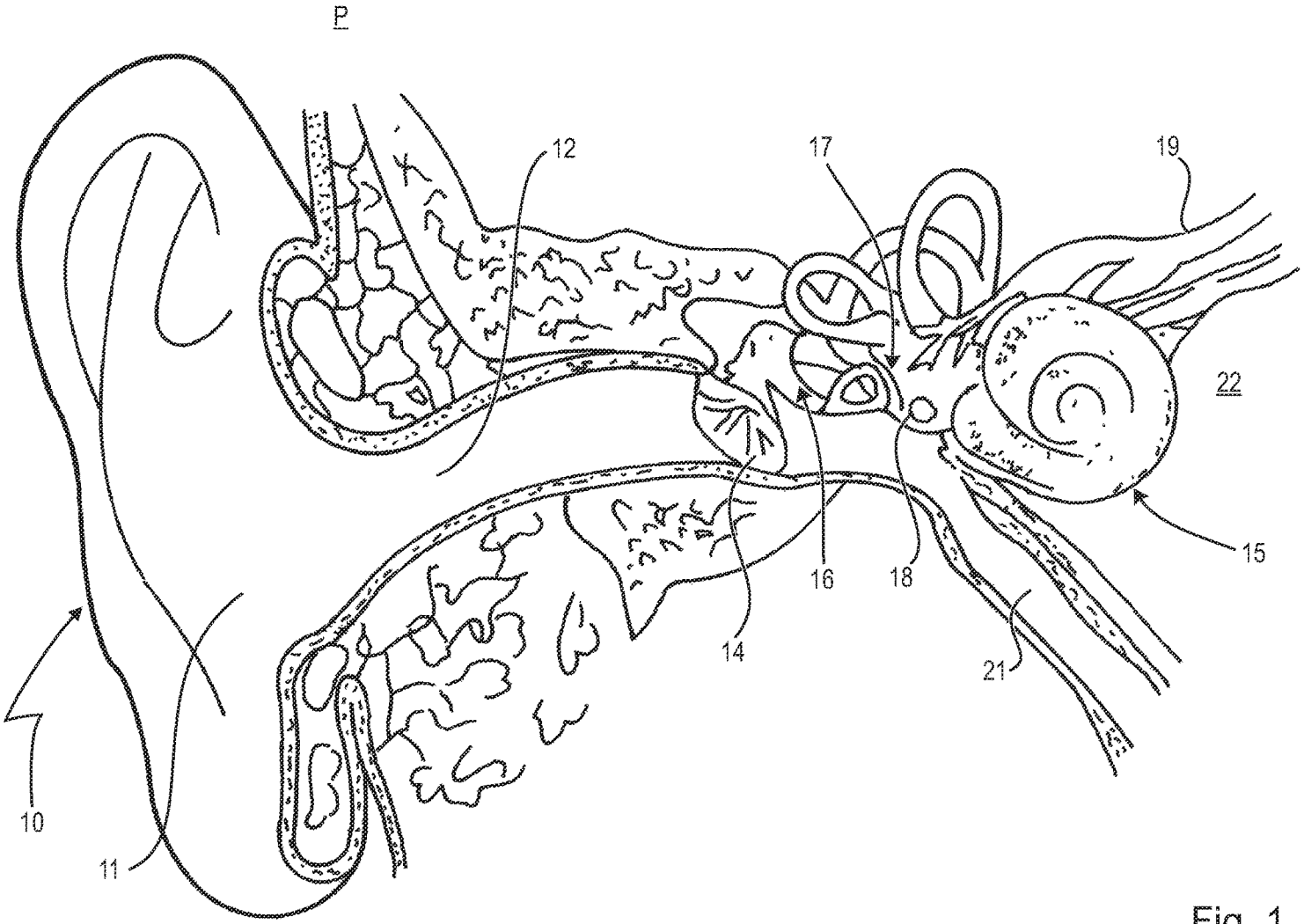
FIG. 1 shows a partially sectional view of a human ear.

FIG. 1 shows a human ear 10 of a patient P in a schematic and partially sectional view. Sound (tones and noises) are collected by the ear cup 11 and are guided along the ear canal (outer ear) 12 in direction of the tympanic membranes 14. The sound hits the tympanic membrane 14 and is transmitted into the cochlea 15 via a system of bones (ossicles or ossicle chain) 16, which serve as levers providing amplification and an acoustic matching transformation to a stamp or a membrane 17 called the "oval window".

The cochlea 15 is a spirally wound tube resembling a snail shell, which in an unwound state is about 35 mm long and is divided over the larger part of its entire length by a separating wall called the "basilar membrane". A lower chamber of the cochlea is called "scala tympani" and an upper chamber is called "scala vestibuli". The cochlea 15 is filled with a fluid (perilymph) having a viscosity approximately corresponding to the viscosity of water. The scala tympani is provided with a second membrane 18 called the "oval window" which serves for receiving a displacement of the fluid if the oval window 17 is displaced.

When the oval window 17 is acoustically actuated by the ossicles 16, then the basilar membrane is displaced correspondingly and it vibrates by the movement of the fluid in the cochlea 15. The displacement of the basilar membrane stimulates hair cells (sensory cells) which are arranged in a special structure on the basilar membrane (not shown). Movements of these sensory hairs generate electric discharges in fibers of the auditory nerve 19 through the mediation of cells in the spiral ganglion. which are positioned in the modiolus or modiolar septum.

The human ear 10 can roughly be separated into three parts, the outer ear with the ear canal 12, the middle ear 21 and the inner ear 22.

A pressure of the ossicles 16 on the oval window 17 travels as a vibration up the scala vestibuli up to the tip of the cochlea 15 and via the helicotrema (not shown) along the scala tympani again down to the round window 18 that can compensate the applied pressure by stretching or vibration.

Figure 2:
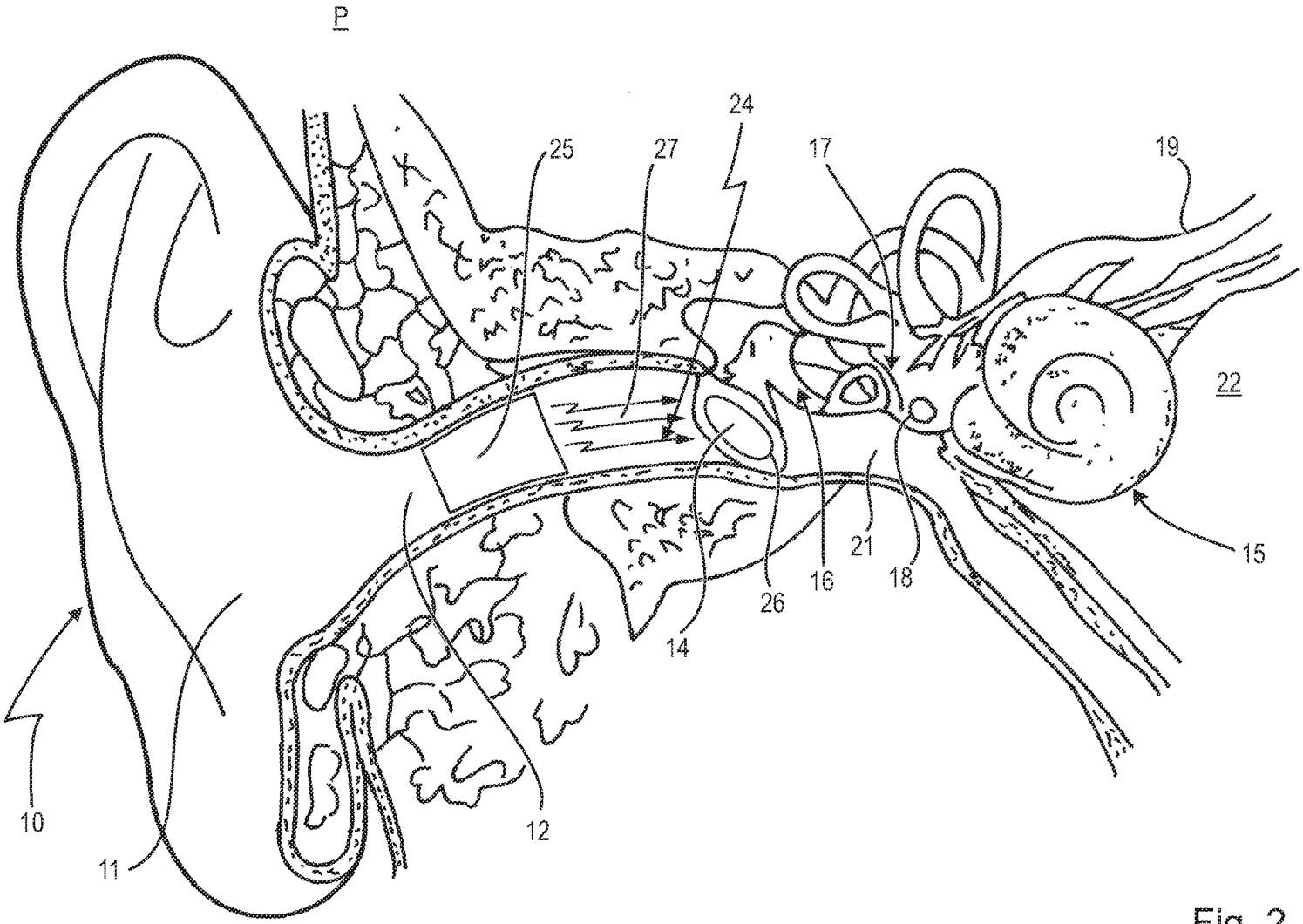
FIG. 2 shows a hearing aid-system comprising a hearing aid and supply module inserted into the ear of FIG. 1.

FIG. 2 shows an embodiment of the hearing aid system 24 according to the present invention inserted into the ear 10.

The hearing aid system 24 according to the invention comprises a supply module 25 inserted into the ear canal and adapted thereto as well as a hearing aid 26 which is exclusively mounted on the tympanic membrane 14, preferably by adhesive forces. The hearing aid 26 is arranged on the side of the tympanic membrane 14 facing the ear canal 12.

While the supply module 25 can also be removed by the patient himself anytime, for example for cleaning or for recharging the electrical energy storage, the hearing aid 26 remains permanently in the ear canal 12, however can also be removed and reinserted non-invasively.

The supply module 25 supplies the hearing aid 26 via an optical link 27 with electrical energy. Via the optical link 27 also hearing signals can be transmitted which in turn represent sound to be played back. The optical link 27 can also, preferably simultaneously, be used for signal as well as energy transmission.

Usually sound reaches the ear cup from the outside, is guided via the ear canal 12 to the tympanic membrane 14 and from there forwarded via the ossicle chain 16 to the inner ear 22 shown here in snail-like form. In the hearing aid system 24 according to the invention the hearing aid 26 is "glued" to the side of the tympanic membrane 14 which is facing the ear canal 12. The ossicle chain 16 is thus further used for signal transmission from the tympanic membrane 14 to the inner ear 22.

Figure 3:
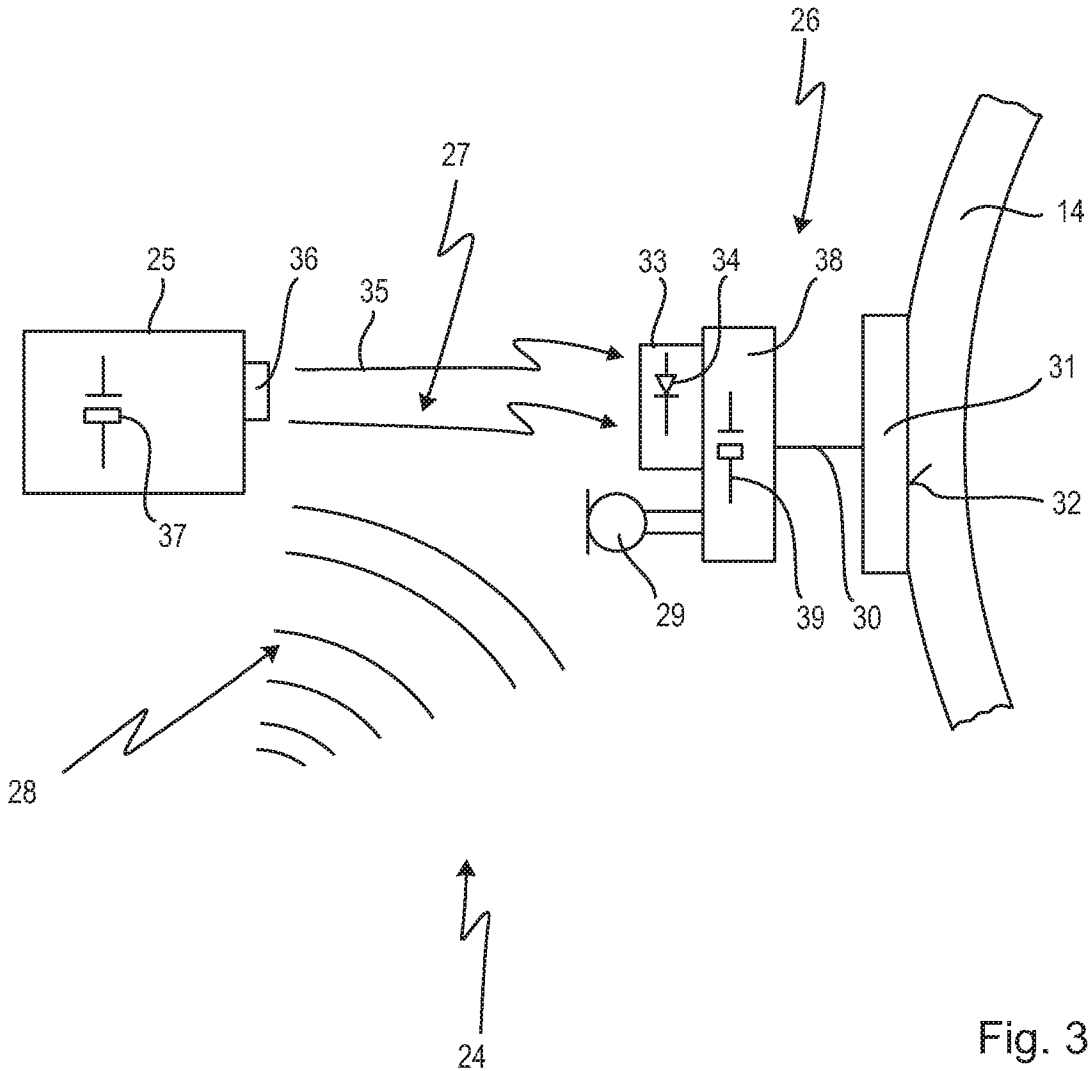
FIG. 3 shows the hearing aid-system of FIG. 2 in a schematic side view.

In the hearing aid system 24, schematically shown in FIG. 3, the transmission of hearing signals of the hearing aid 26 is not effected via the optical link 27, but the acoustic signals 28, thus sound in form of tones and noises, directly reaches the hearing aid 26, where they are received by a microphone unit 29 and converted into electrical control signals 30 that control an actuator 31. which with its inner surface 32 directly contacts the tympanic membrane 14 and deforms the same according to the sound, i.e., stimulates mechanically.

On the hearing aid 26, facing the supply module 25 an array 33 of optoelectronic sensors 34 is arranged that receives energy signals via the optical link 27 in form of light rays 35, which are emitted from a light emitter 36 that is arranged at the supply module 25. Mainly LEDs are used as light emitters 36, emitting light rays 35 in a wavelength region of 800 nm.

The optoelectronic sensors 34 convert the light rays 35 into electrical energy that is used in the hearing aid 26 for mechanically stimulating the tympanic membrane 14.

In the supply module 25 there is further provided a storage element 37 for electrical energy that supplies the light emitter 36 with the required energy. The storage element 37 is inductively supplied with energy either in situ via electromagnetic radiation or extra-corporally in a charging station.

The hearing aid 26 comprises a control unit 38 which controls the actuator 31 via the control signals 30 by means of the electrical energy provided by the array 33, which can be buffered by a storage element 39, which is provided if needed, and in dependence of the output signals of the microphone unit 29.

Figure 4:
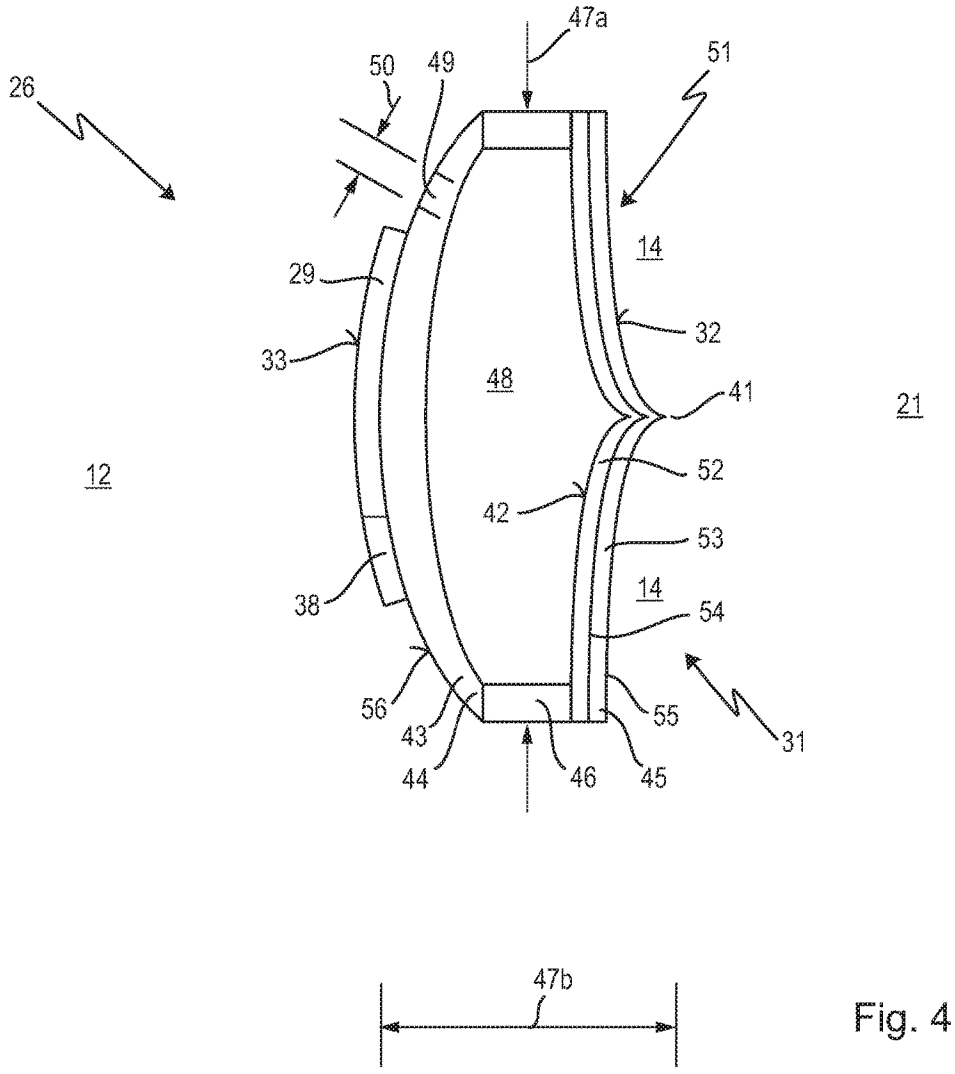
FIG. 4 shows an enlarged and schematic view of the hearing aid of FIG. 3.

In FIG. 4 the hearing aid 26 is shown in an enlarged and schematically illustrated embodiment. The hearing aid 26 is placed inside in the ear canal 12 directly at the tympanic membrane 14, which separates the ear canal 12 from the middle ear 21.

The actuator 31 is a piezo-disk actuator, whose inner surface 32 is centrally applied to the umbo 41 of the tympanic membrane 14 and contacting the tympanic membrane 14 over an area via adhesion. At its outer surface 42 the actuator 31 comprises a cover plate 43, in the shown embodiment curved outward in a direction towards the ear canal 12, to the edge 44 of which the actuator 31 is connected at its edge 45 via a spacer ring 46, which provides the hearing aid 26 an outer diameter 47*a* of 4 to 8 mm and a thickness 47*b* of approximately 2 mm.

The actuator 31, cover plate 43 and spacer ring 46 in this example delimit a lenticular cavity 48 which is connected to the ear canal 12 via a small vent opening 49 in the cover plate 43. The vent opening 49 comprises such a small diameter 50 (of about 0.01 mm) that an air exchange between the ear canal 12 and the cavity 48 is only enabled for low frequencies of preferably below 20 Hz.

The actuator 31 comprises a membrane structure 51 formed by an inner carrier layer 52 made of silicon, an outer layer 53 of piezo-material arranged on the carrier layer 52, an electrode layer 54 between the carrier layer 52 and layer 53. and an electrode layer 55 on an inner surface 32. Via the electrode layers 54, 55 an electrical voltage can be applied to layer 53, which depending on its polarity causes the membrane structure 51 to oscillate outwards, thus in FIG. 4 to the right, or inwards, thus into the cavity 48, whereby the tympanic membrane 14 is a really deformed correspondingly. If an oscillating current or voltage is applied to the electrode layers 54, 55. the membrane structure 51 is set into vibration.

The piezo-disk actuator can comprise a segmented or a non-segmented membrane structure 51.

A respective piezo-disk actuator is in principle known from the aforementioned EP 2 362 686 A2, the content of which is herewith incorporated by reference to the subject matter of the present application. For further details reference is made to the afore-mentioned EP 2 362 686 A2.

Compared to the membrane structure 51 the cover plate 43 is sufficiently rigid that the cover plate 43 is not deformed by vibrations of the membrane structure 51 in the acoustic frequency range (20 to 30,000 Hz) via the pressure changes in the cavity 48 caused thereby. The vent opening 49 thereby enables a low frequency exchange of air between the cavity 48 and the air in the ear canal 12 to avoid static pressure differences.

Figure 5:
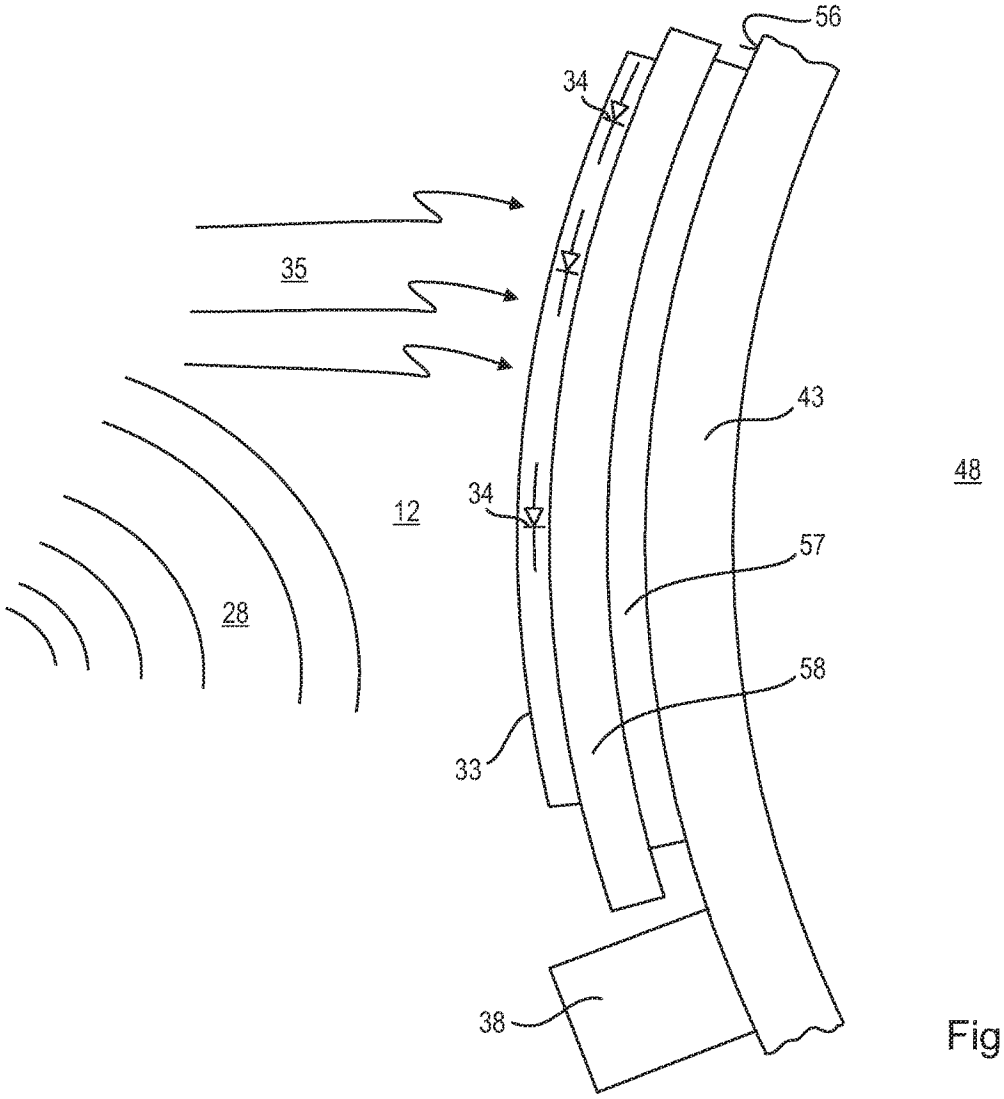
FIG. 5 shows an enlarged view of the cover plate of the hearing aid of FIG. 4.

The cover plate 43 carries the array 33, the control unit 38 and the microphone unit 29 on its outer surface 56 facing the ear canal 12 as shown schematically and not to scale in FIG. 5, in which the cover plate 43 is shown enlarged and in sectional view.

The microphone unit 29 is provided as an electret microphone and comprises a microphone transducer 57 on the outer surface 56, which converts oscillations of a membrane 48 caused by the acoustic signals 28 into electrical signals. On the membrane 58 an array 33 of optoelectronic sensors 34 is arranged. In this way the entire area of the membrane 58 serves both for reception of the acoustic signals 28 as well as for the reception of light rays 35, which not only provides a high sensitivity of the electret microphone but also for positional insensitivity of the optical energy transmission link 27.

For this purpose thin-film photodiodes can be used as sensors 34, as described in the afore-mentioned EP 0 696 907 B1, the content of which is herewith incorporated by reference to the subject matter of the present application. For further details reference is made to the afore-mentioned EP 0 696 907 B1.

The invention claimed is:

1. A hearing aid configured to be inserted into an ear canal of a patient, comprising an actuator that effects a mechanical stimulation of the tympanic membrane, wherein the actuator comprises an inner surface associated with the tympanic membrane and an outer surface associated with the ear canal, the actuator being configured as an areal disk actuator, whose deformation stimulates the tympanic membrane by areal deformation; wherein the hearing aid further comprises at least one first receiver for energy signals; wherein the at least one first receiver comprises at least one optoelectronic sensor that converts light energy to electrical energy; wherein the at least one first receiver comprises an areal array of optoelectronic sensors.

2. The hearing aid of claim 1, wherein the actuator is configured as a piezo disk actuator.

3. The hearing aid of claim 1, wherein a cover plate, is arranged on the actuator at a distance from the outer surface which together with the outer surface delimits a cavity.

4. The hearing aid of claim 3, wherein said cover plate is convex towards the ear canal.

5. A hearing aid configured to be inserted into an ear canal of a patient, comprising an actuator that effects a mechanical stimulation of the tympanic membrane, wherein the actuator comprises an inner surface associated with the tympanic membrane and an outer surface associated with the ear canal, the actuator being configured as an areal disk actuator, whose deformation stimulates the tympanic membrane by areal deformation; wherein the hearing aid comprising at least one second receiver for hearing signals; wherein the at least one second receiver comprises a microphone unit, which receives acoustic signals as hearing signals and converts them into electrical control signals for the actuator.

6. The hearing aid of claim 5, comprising at least one first receiver for energy signals; and wherein the microphone unit comprises a membrane, on which the at least one first receiver is arranged at least in part.

7. The hearing aid of claim 1, having a diameter between 4 and 10 mm.

8. The hearing aid of claim 1, wherein the inner surface of the actuator is adapted to the form of the tympanic membrane such that the inner surface is attachable to the tympanic membrane centrically to the umbo.

9. The hearing aid of claim 1, configured to remain fixed at the tympanic membrane by the adhesive forces between the tympanic membrane and the actuator.

10. The hearing aid of claim 1, wherein the actuator is configured to transmit the areal deformation to the tympanic membrane based on a surface tension in a boundary layer between the inner surface of the actuator and the tympanic membrane.

11. A hearing aid configured to be inserted into an ear canal of a patient, comprising an actuator that effects a mechanical stimulation of the tympanic membrane, wherein the actuator comprises an inner surface associated with the tympanic membrane and an outer surface associated with the ear canal, the actuator being configured as an areal disk actuator, whose deformation stimulates the tympanic membrane by areal deformation; wherein the hearing aid further comprising a control unit, which converts energy signals of at least one first receiver and hearing signals of at least one second receiver into control signals for the actuator.

12. A hearing aid system comprising a hearing aid associated with a supply module, wherein the hearing aid is configured to be inserted into an ear canal of a patient, comprising an actuator that effects a mechanical stimulation of the tympanic membrane, wherein the actuator comprises an inner surface associated with the tympanic membrane and an outer surface associated with the ear canal, the actuator being configured as an areal disk actuator, whose deformation stimulates the tympanic membrane by areal deformation; wherein at least one first receiver for energy signals and at least one second receiver for hearing signals are arranged on the hearing aid, and wherein the supply module comprises at least one emitter for energy signals.

13. The hearing aid of claim 12, wherein the emitter for energy signals comprises a light emitter selected from the group consisting of light guides, lasers, LEDs and OLEDs.

14. The hearing aid of claim 12, wherein the supply module comprises a light emitter for hearing signals.

15. The hearing aid of claim 12, wherein the supply module is configured as an entity configured to be inserted into the ear canal of the patient.

16. A hearing aid configured to be inserted into an ear canal of a patient, comprising an actuator that effects a mechanical stimulation of the tympanic membrane; and a cover plate, wherein the actuator comprises an inner surface associated with the tympanic membrane and an outer surface associated with the ear canal and wherein the cover plate is arranged on the actuator at a distance from the outer surface which together with the outer surface delimits a cavity.

17. The hearing aid of claim 16, wherein said cover plate is convex towards the ear canal.

18. The hearing aid of claim 16, wherein the cavity delimited by the cover plate together with the outer surface is a lenticular cavity.

19. The hearing aid of claim 16, wherein a spacer ring is arranged between the areal actuator and the cover plate.

20. The hearing aid of claim 16, wherein the cover plate is rigid compared to the actuator.

21. The hearing aid of claim 16, wherein in the cover plate at least one vent opening leading into the cavity is provided.

22. The hearing aid of claim 21, wherein the vent opening has a diameter allowing an exchange of air between the ear canal and the cavity only for frequencies of below 20 Hz.

23. The hearing aid of claim 22, wherein the diameter of the vent opening is between 0.01 and 0.1 mm.

24. The hearing aid of claim 16, having a diameter between 4 and 10 mm.

25. The hearing aid of claim 16, wherein the inner surface of the actuator is adapted to the form of the tympanic membrane such that the inner surface is attachable to the tympanic membrane centrically to the umbo.

26. A hearing aid configured to be inserted into an ear canal of a patient, comprising a piezo disk actuator that effects a mechanical stimulation of the tympanic membrane; and a cover plate, wherein the actuator comprises an inner surface associated with the tympanic membrane and an outer surface associated with the ear canal, the actuator being configured as an areal disk actuator, whose deformation stimulates the tympanic membrane by areal deformation; and wherein the cover plate is arranged on the actuator at a distance from the outer surface which together with the outer surface delimits a cavity.

27. The hearing aid of claim 26, wherein said cover plate is convex towards the ear canal; and the hearing aid comprises a control unit, arranged on the cover plate, which control unit converts energy signals of at least one first receiver and hearing signals of at least one second receiver into control signals for the actuator.

28. The hearing aid of claim 16, configured to remain fixed at the tympanic membrane by the adhesive forces between the tympanic membrane and the actuator.

29. The hearing aid of claim 16, wherein the actuator is configured to transmit the areal deformation to the tympanic membrane based on a surface tension in a boundary layer between the inner surface of the actuator and the tympanic membrane.

* * * * *